US005417778A

United States Patent [19]

Nachtrab et al.

[11] Patent Number: 5,417,778

[45] Date of Patent: May 23, 1995

[54] DUCTILE, LIGHT WEIGHT, HIGH STRENGTH BERYLLIUM-ALUMINUM CAST COMPOSITE ALLOY

[75] Inventors: William T. Nachtrab, Maynard; Nancy F. Levoy, Acton; Raymond L. White, III, Medford, all of Mass.

[73] Assignee: Nuclear Metals, Inc., Concord, Mass.

[21] Appl. No.: 187,684

[22] Filed: Jan. 26, 1994

[51] Int. Cl.[6] ..... C22C 25/00

[52] U.S. Cl. ..... 148/400; 420/401

[58] Field of Search ..... 148/400; 420/401

[56] References Cited

U.S. PATENT DOCUMENTS

| | | | |
|---|---|---|---|
| 1,816,961 | 8/1931 | Cooper | 420/401 |
| 1,859,413 | 5/1932 | Smith | 420/580 |
| 3,082,521 | 3/1963 | Cohen | 148/430 |
| 3,264,147 | 8/1966 | Benfield et al. | 148/405 |
| 3,322,512 | 5/1967 | Krock et al. | 420/401 |

*Primary Examiner*—Richard O. Dean
*Assistant Examiner*—Sikyin Ip
*Attorney, Agent, or Firm*—Joseph S. Iandiorio

[57] ABSTRACT

A light weight, high strength quaternary or higher-order cast beryllium-aluminum alloy, including approximately 60 to 70 weight % beryllium, and from approximately 0.2 to 5 weight % germanium and from 0.2 to 4.25 weight % silver, with the balance aluminum. Beryllium strengthening elements selected from the group consisting of copper, nickel, or cobalt may be present at from 0.1 to 5.0 weight % of the alloy to increase the alloy strength.

5 Claims, 2 Drawing Sheets

Be-31Al-3Ag-0.75Ge as extruded, longitudinal section

Be-40 Al

Be-31 Al-2Ag-2Ge

Be-30Al-3Ag-0.75Ge-0.75Co

Be-28Al-3Ag-0.75Ge-3Co

Be-31Al-3Ag-0.75Ge as extruded transverse section

Be-31Al-3Ag-0.75Ge as extruded, longitudinal section

DUCTILE, LIGHT WEIGHT, HIGH STRENGTH BERYLLIUM-ALUMINUM CAST COMPOSITE ALLOY

FIELD OF INVENTION

This invention relates to a ductile, light weight, high strength beryllium-aluminum alloy suitable for the manufacture of precision castings or wrought material produced from ingot castings.

BACKGROUND OF INVENTION

Beryllium is a high strength, light weight, high stiffness metal that has extremely low ductility which prevents it from being cast and also creates a very low resistance to impact and fatigue, making the cast metal or metal produced from castings relatively useless for most applications.

To increase tile ductility of beryllium, much work has been done with beryllium-aluminum alloys to make a ductile, two phase, composite of aluminum and beryllium. Aluminum does not react with the reactive beryllium, is ductile, and is relatively lightweight, making it a suitable candidate for improving the ductility of beryllium, while keeping tile density low. However, beryllium-aluminum alloys are inherently difficult to cast due to the mutual insolubility of beryllium and aluminum in the solid phase and the wide solidification temperature range typical in this alloy system. An alloy of 60 weight % beryllium and 40 weight % aluminum has a liquidus temperature (temperature at which solidification begins) of nearly 1250° C. and a solidus temperature (temperature of complete solidification) of 645° C. During the initial stages of solidification, primary beryllium dendrites form in the liquid to make a two phase solid-liquid mixture. The beryllium dendrites produce a tortuous channel for the liquid to flow and fill during the last stages of solidification. As a result, shrinkage cavities develop, and these alloys typically exhibit a large amount of microporosity in the as-cast condition. This feature greatly affects the properties and integrity of the casting. Porosity leads to low strength and premature failure at relatively low ductilities. In addition, castings have a relatively coarse microstructure of beryllium distributed in an aluminum matrix, and such coarse microstructures generally result in low strength and low ductility. To overcome the problems associated with cast structures, a powder metallurgical approach has been used to produce useful materials from beryllium-aluminum alloys.

There have also been proposed ternary beryllium-aluminum alloys made by powder metallurgical approaches. For example, U.S. Pat. No. 3,322,512, Krock et al., May 30, 1967, discloses a beryllium-aluminum-silver composite containing 50 to 85 weight % beryllium, 10.5 to 35 weight % aluminum, and 4.5 to 15 weight % silver. The composite is prepared by compacting a powder mixture having the desired composition, including a fluxing agent of alkali and alkaline earth halogenide agents such as lithium fluoride-lithium chloride, and then sintering the compact at a temperature below the 1277° C. melting point of beryllium but above the 620° C. melting point of the aluminum-silver alloy so that the aluminum-silver alloy liquifies and partially dissolves the small beryllium particles to envelope the brittle beryllium in a more ductile aluminum-silver-beryllium alloy. U.S. Pat. No. 3,438,751, issued to Krock et al. on Apr. 15, 1969, discloses a beryllium-aluminum-silicon composite containing 50 to 85 weight % beryllium, 13 to 50 weight % aluminum, and a trace to 6.6 weight % silicon, also made by the above-described powder metallurgical liquid sintering technique. However, high silicon content reduces ductility to unacceptably low levels, and high silver content increases alloy density.

Other ternary, quaternary and more complex beryllium-aluminum alloys made by powder metallurgical approaches have also been proposed. See, for example, McCarthy et al., U.S. Pat. No. 3,664,889. That patent discloses preparing the alloys by atomizing a binary beryllium-aluminum alloy to create a powder that then has mixed into it fine elemental metallic powders of the desired alloying elements. The powders are then mixed together thoroughly to achieve good distribution, and the powder blend is consolidated by a suitable hot or cold operation, carried on without any melting.

It is known, however, that beryllium-aluminum alloys tend to separate or segregate when cast and generally have a porous cast structure. Accordingly, previous attempts to produce beryllium-aluminum alloys by casting resulted in low strength, low ductility, and coarse microstructures with poor internal quality.

Better ductility with increased strength is desirable as is the avoidance of the need for heat treating which includes solutionizing, quenching and aging which can cause dimensional distortion in precision cast parts.

SUMMARY OF INVENTION

It is therefore an object of this invention to provide an improved more ductile, light weight, high strength beryllium-aluminum alloy suitable for casting.

It is a further object of this invention to provide such an alloy which is much more ductile than beryllium-aluminum alloys containing silicon or silicon and silver.

It is a further object of this invention to provide such an alloy which does not require heat treatment to achieve high strength properties.

It is a further object of this invention to provide such an alloy which has optimum properties without heat treating and so does not suffer dimensional distortion in cast parts brought about by the solutionizing and quenching procedures of heat treatment.

It is a further object of this invention to provide such an alloy which has significantly increased strength while maintaining a much increased ductility.

It is a further object of this invention to provide such an alloy that can be cast without microporosity, that is detrimental to mechanical properties of a cast product.

It is a further object of this invention to provide such an alloy that has a relatively fine as-cast microstructure.

It is a further object of this invention to provide such an alloy that has a higher strength than has previously been attained for other cast beryllium-aluminum alloys or cast beryllium-aluminum alloys containing silicon.

It is a further object of this invention to provide such an alloy that has a density of less than 2.2 grams per cubic centimeter (0.079 pounds per cubic inch).

It is a further object of this invention to provide such an alloy that has an elastic modulus (stiffness) greater than 28 million psi.

It is a further object of this invention to provide such an alloy that can be cast without segregation.

It is a further object of this invention to provide such an alloy that can be cast and hot worked by rolling, extrusion, swaging, etc.

This invention results from the realization that a light weight, high strength and much more ductile beryllium-aluminum alloy capable of being cast with virtually no segregation and microporosity may be accomplished with approximately 60 to 70 weight % beryllium, approximately 0.2 to 5 weight % germanium and approximately 0.2 to 4.25 weight % silver, and aluminum. It has been found that including both germanium and silver creates an as-cast alloy having very desirable properties with greatly improved ductility over cast binary beryllium-aluminum alloys or beryllium-aluminum alloys containing silicon, which does not require heat treatment for optimization, thereby allowing the alloy to be used to cast intricate shapes that accomplish strong, lightweight stiff metal parts or cast ingots that can be rolled, extruded or otherwise mechanically worked.

This invention features a quaternary or higher-order cast beryllium-aluminum alloy, comprising approximately 60 to 70 weight % beryllium; approximately 0.2 to 5 weight % germanium and from 0.2 to approximately 4.25 weight % silver; and aluminum. The beryllium may be strengthened by adding copper, nickel or cobalt in the amount of approximately 0.1 to 5 weight % of the alloy. The alloy may be wrought after casting to increase ductility and strength. Heat treating is not necessary, although the alloy may be hot isostatically pressed to further increase strength and ductility of a casting.

DISCLOSURE OF PREFERRED EMBODIMENTS

Other objects, features and advantages will occur to those skilled in the art from the following description of preferred embodiments and the accompanying drawings in which.

Figure 1A:
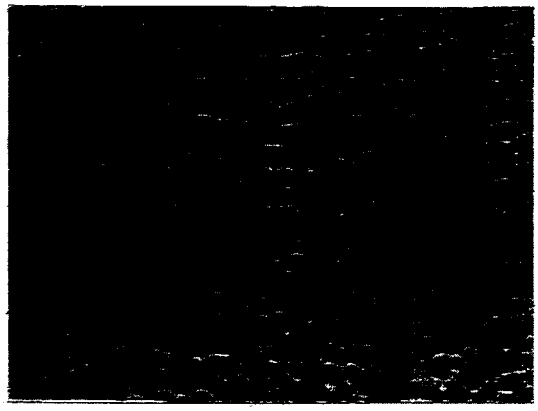
FIG. 1A is a photomicrograph of cast microstructure typical of prior art alloys.

This invention may consist essentially of a quaternary or higher-order cast beryllium-aluminum alloy comprising approximately 60 to 70 weight % beryllium, approximately 0.2 to 5 weight % germanium, silver from approximately 0.2 weight % to approximately 4.25 weight %, and aluminum. Further strengthening can be achieved by the addition of an element selected from the group consisting of copper, nickel, and cobalt, present as approximately 0.1 to 5.0 weight % of the alloy. The alloy is lightweight and has high stiffness. The density is no more than 0.079 lb/cu.in., and the elastic modulus is greater than 28 million pounds per square inch (mpsi).

As described above, prior art beryllium-aluminum alloys, FIG. 1 A, have not been successfully cast without segregation and microporosity. Accordingly, it has to date been impossible to make precision cast parts by processes such as investment casting, die casting or permanent mold casting from beryllium-aluminum alloys. However, there is a great need for this technology particularly for intricate parts for aircraft and spacecraft, in which superior ductility, light weight, strength and stiffness are uniformly required.

The beryllium-aluminum alloys of this invention include germanium and silver. The silver increases the strength and ductility of the alloy in compositions of from 0.2 to 4.25 weight % of the alloy. Germanium present at from 0.2 to 5 weight % levels can lead to increases in ductility of up to 100% more than the same alloy including silicon instead of germanium. Germanium also aids in the castability of the alloy by decreasing microporosity. Without germanium the alloy has more microporosity in the cast condition which leads to lower strength and ductility. Additionally, the alloy including germanium appears to be optimally strengthened in the as-cast condition as it has the same properties before and after heat treatment (solution heat treating, quenching, and aging). Thus, heat treatment that is required to give optimal properties for beryllium-aluminum alloys containing silicon and silver is not necessary for the germanium containing alloys. Since heat treatment comprising solutionizing, quenching, and aging can cause dimensional distortion in precision cast parts, the elimination of this heat treatment is a significant advantage for the germanium containing alloys. It should be noted that the advantages described here are believed to be related to interactions between silver and germanium in these alloys, and not to germanium acting alone.

The beryllium phase in the germanium containing alloys can be strengthened through addition of cobalt, nickel, or copper in a manner similar to that described for beryllium-aluminum alloys containing silicon instead of germanium. The advantage for the germanium containing alloys is that higher levels of strengthening can be achieved through these alloy additions, while still maintaining sufficient ductility, than was possible for the silicon containing alloys.

Further hot isostatic pressing (HIP) of the germanium containing alloys not only results in property improvements including an average improvement of greater than 100% for ductility (as measured by % elongation and % reduction of area), but it also produces modest increases in strength (approximately 5 % for yield strength and 15 % for ultimate tensile strength). And these property improvements are achieved without dimensional distortion in precision cast parts. Further improvements in strength and ductility occur if the alloy is wrought after casting.

It has also been found that the beryllium phase can be strengthened by including copper, nickel or cobalt at from approximately 0.1 to 5.0 weight % of the alloy. The strengthening element goes into the beryllium phase to increase the yield strength of the alloy by up to 25% without a real effect on the ductility of the alloy. Greater additions of the strengthening element cause the alloy to become more brittle.

The following are examples of seven alloys made using germanium and silver according to this invention.

EXAMPLE I

A 725.75 gram charge with elements in the proportion of (by weight percent) 31A1, 2Ag, 2Ge and the remainder Be was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 22.6 ksi tensile yield strength, 33.5 ksi ultimate tensile strength, and 4.7% elongation. The density of this ingot was 2.15 g/cc and the elastic modulus was 29.7 mpsi. These properties can be compared to the properties of a binary alloy (60 weight % Be, 40 weight % Al, with total charge weight of 853.3 grams) that was melted in a vacuum induction furnace and cast into a mold with a rectangular cross section measuring 3 inches by ⅜ inch. The properties of the binary alloy were 10.9 ksi tensile yield strength, 12.1 ksi ultimate tensile strength, 1% elongation, 30.7 mpsi elastic modulus, and 2.15 g/cc density.

EXAMPLE II

A 725.75 gram charge with elements in the proportion of (by weight percent) 31Al, 3Ag, 0.75Ge and the remainder Be was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 20.6 ksi tensile yield strength, 30.4 ksi ultimate tensile strength, and 4.7% elongation. The density of this ingot was 2.13 g/cc and the elastic modulus was 32.2 mpsi.

EXAMPLE III

A 725.75 gram charge with elements in the proportion of (by weight percent) 30Al, 3Ag, 0.75Ge, 0.75Co and the remainder Be was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 27.6 ksi tensile yield strength, 35.7 ksi ultimate tensile strength, and 2.1% elongation. The density of this ingot was 2.12 g/cc and the elastic modulus was 32.1 mpsi.

A section of the cast ingot was HIP processed for two hours at a temperature of 550° C. and a pressure of 15 ksi. Tensile properties of this HIP material were 28.7 ksi tensile yield strength, 41.5 ksi ultimate tensile strength, and 6.4% elongation. The density of this material was 2.15 g/cc and the elastic modulus was 33.0 mpsi.

EXAMPLE IV

A 725.75 grain charge with elements in the proportion of (by weight percent) 30Al, 3Ag, 0.75Ge, 1Co and the remainder Be was placed in a crucible and melted in a vacuum induction furnace. The molten metal was poured into a 1.625 inch diameter cylindrical mold, cooled to room temperature and removed from the mold. Tensile properties were measured on this material in the as-cast condition. As-cast properties were 29.0 ksi tensile yield strength, 38.3 ksi ultimate tensile strength, and 3.8% elongation. The density of this ingot was 2.16 g/cc and the elastic modulus was 32.6 mpsi.

A section of the cast ingot was HIP processed for two hours at a temperature of 550° C. and a pressure of 15 ksi. Tensile properties of this HIP material were 29.9 ksi tensile yield strength, 41.0 ksi ultimate tensile strength-,and 6.2% elongation. The density of this material was 2.16 g/cc and the elastic modulus was 32.8 mpsi.

EXAMPLE V

A 725.75 gram charge with elements in the proportion of (by weight percent) 29 Al, 3Ag, 0.75Ge, 2Co and the remainder Be was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 36.4 ksi tensile yield strength, 43.1 ksi ultimate tensile strength, and 1.6% elongation. The density of this ingot was 2.17 g/cc and the elastic modulus was 33.0 mpsi.

A section of the cast ingot was HIP processed for two hours at a temperature of 550° C. and a pressure of 15 ksi. Tensile properties of this HIP material were 37.9 ksi tensile yield strength, 47.2 ksi ultimate tensile strength, and 4.0% elongation. The density of this material was 2.15 g/cc and the elastic modulus was 33.7 mpsi.

EXAMPLE VI

A 725.75 gram charge with elements in the proportion of (by weight percent) 28Al, 3Ag, 0.75Ge, 3Co and the remainder Be was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 39.4 ksi tensile yield strength, 46.0 ksi ultimate tensile strength, and 1.9% elongation. The density of this ingot was 2.17 g/cc and the elastic modulus was 31.9 mpsi.

A section of the cast ingot was HIP processed for two hours at a temperature of 550° C. and a pressure of 15ksi. Tensile properties of this HIP material were 41.8 ksi tensile yield strength, 51.0 ksi ultimate tensile strength, and 2.6% elongation. The density of this material was 2.17 g/cc and the elastic modulus was 33.2 mpsi.

EXAMPLE VII

A 725.75 gram charge with elements in the proportion of (by weight percent) 31Al, 3Ag, 0.75Ge and the remainder Be was placed in a crucible and melted in a vacuum induction furnace. The molten metal was poured into a 1.625 inch diameter cylindrical mold, cooled to room temperature, and removed from the mold. The resulting ingot was canned in copper, heated to 450° C., and extruded to a 0.55 inch diameter rod. Tensile properties were measured on this material in the as-extruded condition. Extruded properties were 48.9 ksi tensile yield strength, 63.6 ksi ultimate tensile strength, and 12.5% elongation. The density of this extruded rod was 2.09 g/cc and the elastic modulus was 35 mpsi.

The properties of the alloys presented in the preceding examples are summarized in Table 1.

TABLE 1

| No. | Composition | Condition | 0.2% YS (ksi) | UTS (ksi) | % E (in 1") | Density (g/cc) | Elastic Modulus (Mpsi) |
|---|---|---|---|---|---|---|---|
| | Be-40Al | as-cast | 10.9 | 12.1 | 1.0 | 2.15 | 30.7 |
| I | Be-31Al-2Ag-2Ge | as-cast | 22.6 | 33.5 | 4.7 | 2.15 | 29.7 |
| II | Be-31Al-3Ag-0.75Ge | as-cast | 20.6 | 30.4 | 4.7 | 2.13 | 32.2 |

TABLE 1-continued

| No. | Composition | Condition | 0.2% YS (ksi) | UTS (ksi) | % E (in 1") | Density (g/cc) | Elastic Modulus (Mpsi) |
|---|---|---|---|---|---|---|---|
| III | Be-30Al-3Ag-0.75Ge-0.75Co | as-cast | 27.6 | 35.7 | 2.1 | 2.12 | 32.1 |
| | | HIP | 28.7 | 41.5 | 6.4 | 2.15 | 33.0 |
| IV | Be-30Al-3Ag-0.75Ge-1Co | as-cast | 29.0 | 38.3 | 3.8 | 2.16 | 32.6 |
| | | HIP | 29.9 | 41.0 | 6.2 | 2.16 | 32.8 |
| V | Be-29Al-3Ag-0.75Ge-2Co | as-cast | 36.4 | 43.1 | 1.6 | 2.17 | 33.0 |
| | | HIP | 37.9 | 47.2 | 4.0 | 2.15 | 33.7 |
| VI | Be-28Al-3Ag-0.75Ge-3Co | as-cast | 39.4 | 46.0 | 1.9 | 2.17 | 31.9 |
| | | HIP | 41.8 | 51.0 | 2.6 | 2.17 | 33,2 |
| VII | Be-31Al-3Ag-0.75Ge | as-extended | 48.9 | 63.6 | 12.5 | 2.09 | 35.0 |

Figure 1B:
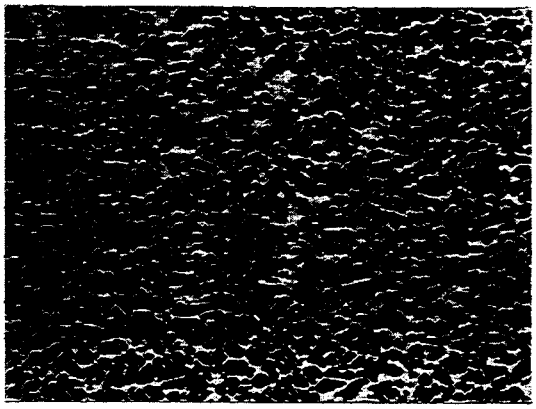
FIG. 1B is a photomicrograph of a cast microstructure of an example of the alloy of this invention.
Figure 1C:
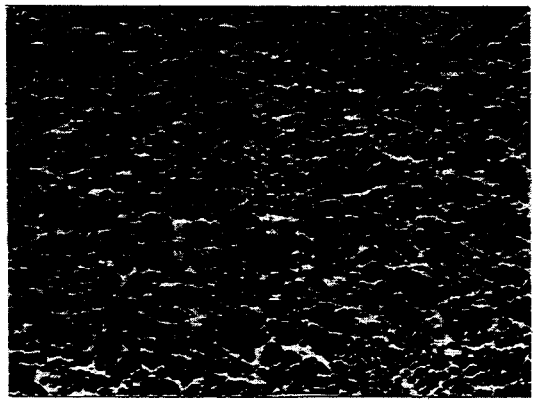
FIG. 1C is a photomicrograph of a cast microstructure of an example of the alloy of this invention.
Figure 1D:
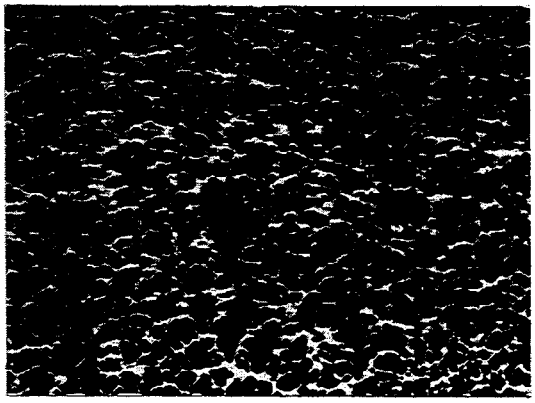
FIG. 1D is a photomicrograph of a cast microstructure of an example of the alloy of this invention.

FIGS. 1B–D show a comparison of cast microstructure for some of the germanium-silver alloys of beryllium-aluminum. The dark phase is beryllium rich; the light phase is aluminum rich. Note the overall uniformity of the microstructure and that the aluminum phase has completely filled the interdendritic space between the beryllium phase, which is essential for good strength and ductility.

Figure 2A:
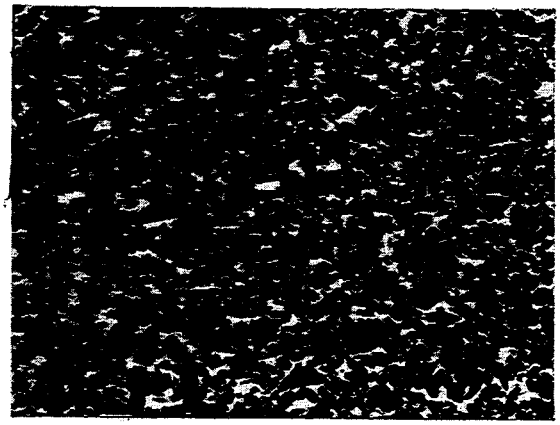
FIG. 2A is a photomicrograph of a microstructure from an extruded alloy of this invention.
Figure 2B:
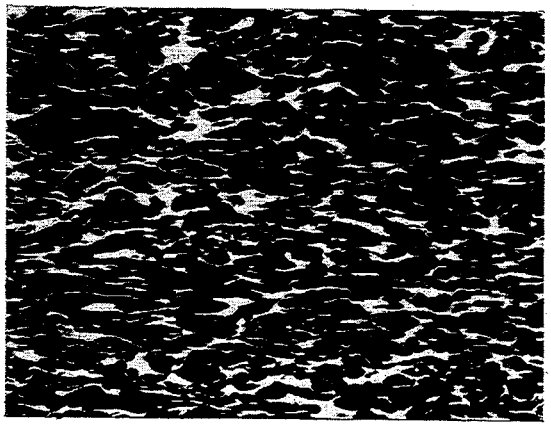
FIG. 2B is a photomicrograph of a microstructure from an extruded alloy of this invention.

FIGS. 2A–B show microstructures from extruded germanium-silver alloys of beryllium-aluminum. An extruded structure shows uniform distribution and deformation of both phases which is necessary to ensure that the alloy does not fracture during deformation. Deformation does not reduce continuity of the aluminum phase so that this structure results in both high strength and ductility.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A quaternary or higher-order cast beryllium-aluminum alloy, comprising approximately 60 to 70 weight % beryllium; and from approximately 0.2 to 5 weight % germanium and from approximately 0.2 to 4.25 weight % silver; and aluminum.

2. The alloy of claim 1 further including a beryllium strengthening element included as approximately 0.1 to 5.0 weight % of the alloy selected from the group consisting of copper, nickel and cobalt.

3. The alloy of claim 1 that has been hot isostatically pressed to improve strength and ductility.

4. The alloy of claims 1, 2, or 3 in which the alloy is wrought after casting to increase ductility and strength.

5. The alloy of claim 2 that has been hot isostatically pressed to improve strength and ductility.

* * * * *